US008104455B2

(12) United States Patent
Kitajima et al.

(10) Patent No.: US 8,104,455 B2
(45) Date of Patent: Jan. 31, 2012

(54) PASSING TYPE FUEL REFORMER

(75) Inventors: Shizuo Kitajima, Yokohama (JP); Takashi Watanabe, Kurume (JP); Noriya Sekine, Yokosuka (JP)

(73) Assignee: Fenie Co., Ltd., Kanagawa (JP)

( * ) Notice: Subject to any disclaimer, the term of this patent is extended or adjusted under 35 U.S.C. 154(b) by 1138 days.

(21) Appl. No.: 10/570,379

(22) PCT Filed: Jul. 1, 2004

(86) PCT No.: PCT/JP2004/009703

§ 371 (c)(1), (2), (4) Date: Feb. 23, 2007

(87) PCT Pub. No.: WO2006/003718

PCT Pub. Date: Jan. 12, 2006

(65) Prior Publication Data

US 2007/0163552 A1 Jul. 19, 2007

(51) Int. Cl.
*F02M 27/06* (2006.01)

(52) U.S. Cl. ..... 123/538

(58) Field of Classification Search ..... 123/536–538
See application file for complete search history.

(56) References Cited

U.S. PATENT DOCUMENTS 5,044,346 A * 9/1991 Tada et al. ..... 123/536
6,205,985 B1 * 3/2001 Funagayama ..... 123/538
7,263,822 B2 * 9/2007 Bender et al. ..... 60/274
7,574,997 B1 * 8/2009 Chauza et al. ..... 123/538
2007/0193537 A1 * 8/2007 Miyasaka ..... 123/3

FOREIGN PATENT DOCUMENTS

JP 06066214 A * 3/1994
JP 3036323 U 1/1997
JP 9-49462 A 2/1997

OTHER PUBLICATIONS

International Preliminary Report on Patentability.

* cited by examiner

*Primary Examiner* — M. McMahon
(74) *Attorney, Agent, or Firm* — Hedman & Costigan, P.C.; James V. Costigan

(57) ABSTRACT

An object of the present invention is to provide a passing type fuel reformer which can reform fuel fed into an engine so as to aim at further enhancing the improvement effect of fuel consumption, and which can be simply and surely installed in the vicinity of a fuel tank. Spherical particles (1*c*) are charged at a filling rate of not less than 90% in a cylindrical body (1) which is formed therein with through-holes at a rate of opening area of not less than 50%, the cylindrical body 1 is loosely fitted in a rigid tube body (2) while a seal member (3) such as an O-ring seal is provided between the outer peripheral surface of the cylindrical body (1) and the inner peripheral surface of the rigid tube body (2), connectors (4) are removably fitted respectively in the opposite ends of the rigid tube body (2), and a connecting pipe (5) is connected to the connectors (4), and is arranged between a fuel tank (7) and the engine body.

2 Claims, 7 Drawing Sheets

PASSING TYPE FUEL REFORMER

TECHNICAL FIELD

The present invention relates to a passing type fuel reformer which is adapted to be used as an accessory of any of various engines for a business truck, a bus, a light van, a passenger vehicle, a marine vessel (e.g. a fishing vessel, leisure fishing boat), an agricultural equipment, a civil engineering and building vehicle (a heavy machine, a truck or the like) or the like, and which reforms liquid fuel such as gasoline, gas oil or heavy fuel oil so as to aim at further enhancing improvement in fuel consumption and acceleration and further enhancing the fuel reforming in order to lower combustion noise and to greatly reduce CO, HC or black smoke or the like in exhaust gas.

BACKGROUND OF THE INVENTION

Conventionally, there has been presented a fuel reformer, as proposed by the applicant (Refer to Japanese Utility Model Registration No. 3,036,323), composed of spherical particles having a substantially equal diameter, which are formed by kneading ceramic powder and radioactive rare-earth mineral ore powder, and then, by granulating, drying, calcining and polishing them, a cylindrical body having a peripheral surface and opposite end lid surfaces which are formed therein with small through-holes with a diameter smaller than that of the spherical particles, at a rate of hole area of not less than 50%, and charged therein with the spherical particles by a filling rate of not less than 90%, a rotation responsive type chain such as a ball chain attached to one of the lids, and a coupler such as a ring attached to the other one them.

Utility Model Document 1:

Japanese Utility Model Registration No. 3,036,323

However, the above-mentioned conventional fuel reformer is adapted to be used being incorporated in a liquid fuel tank for gasoline, gas oil or heavy fuel oil or the like, and accordingly, all fuel fed into an engine not always passes through the fuel reformer, that is, only a part of fuel fed into the engine can pass through the fuel reformer.

DISCLOSURE OF THE INVENTION

An object of the present invention, as a task of the invention, is to provide a passing type fuel reformer through which fuel to be fed into an engine passes by a full quantity, by which the fuel is then at once fed into the engine in order to aim at further enhancing the effect of combustion, and which may be safely and surely mounted in the vicinity of a fuel tank.

According to the present invention, there is provided a passing type fuel reformer as set forth in claim 1, comprising spherical particles having a substantially equal diameter and formed by kneading ceramic powder and radioactive rare-earth mineral ore powder, and by granulating, drying, calcining and polishing them, a cylindrical body having a peripheral surface and surfaces of opposite end lids, which are formed therein with small-through holes with a diameter smaller than that of the spherical particles, at a rate of opening area of not less than 50%, and charged therein with the spherical particles at a filing rate of not less than 90%, wherein a rigid tube body loosely is fitted with the thus formed fuel reformer body in which the cylindrical body charged therein with the spherical particles is covered at its opposite ends with the lids, a seal member such as O-ring is provided between the outer peripheral surface of the fuel reformer body and the inner peripheral surface of the rigid tube body, a removable connectors are provided to opposite ends of the rigid body, and connection pipes are provided to the connectors and connected to a fuel pipe arranged between a fuel tank and an engine body.

The above-mentioned passing type fuel reformer as pointed out in claim 1 is characterized by being provided at a position in a bypass branching from the intermediate part of the fuel pipe.

The passing type fuel reformer as set forth in claim 1 or 2 is characterized in that a steel band fastens the fuel tank, a rubber pedestal having a vibration isolating function is mounted to the said steel band, and the passing type fuel reformer cured to the said rubber pedestal.

Further, the passing type fuel reformer as set forth in claim 1 or 2 is characterized in that a steel pedestal is fixed to a chassis located on the rear side of the fuel tank, and the passing type fuel reformer is secured to the said steel pedestal.

BEST MODE FOR CARRYING OUT THE INVENTION

Figure 1:
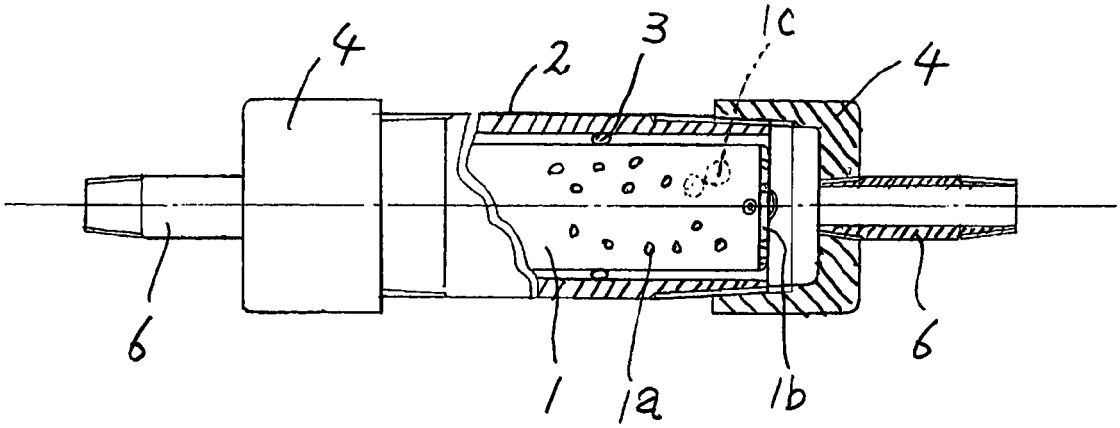
FIG. 1 is a schematic side view illustrating a passing type fuel reformer according to the present invention, which is shows being partly sectioned.
Figure 2:
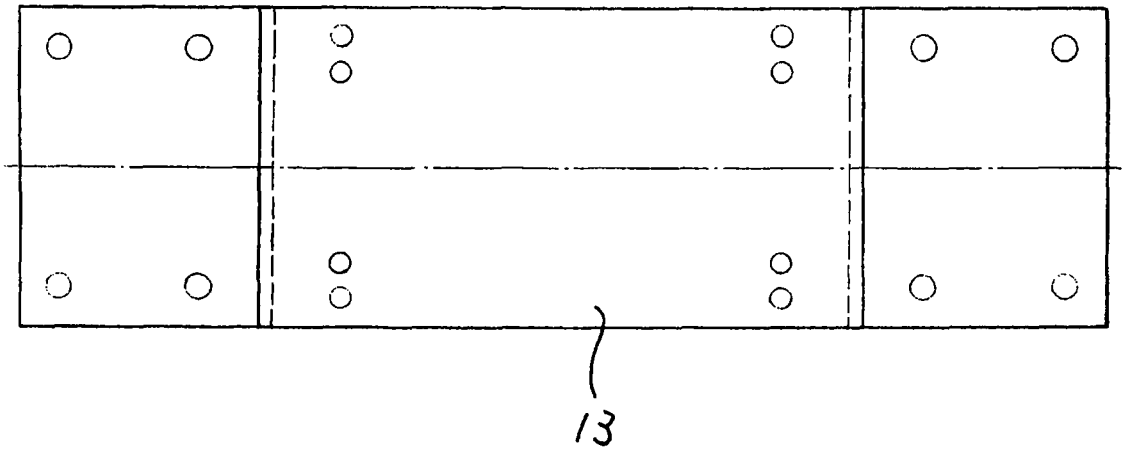
FIG. 2 is a plan view illustrating a steel pedestal.
Figure 3:
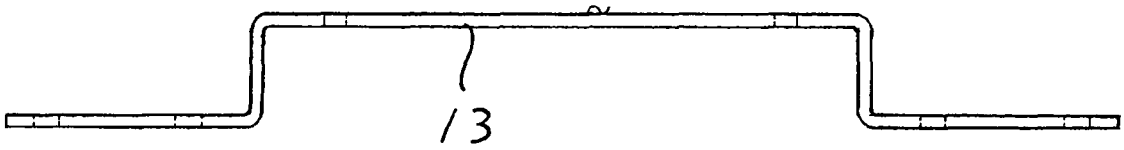
FIG. 3 is a side view illustrating the steel pedestal.
Figure 4:
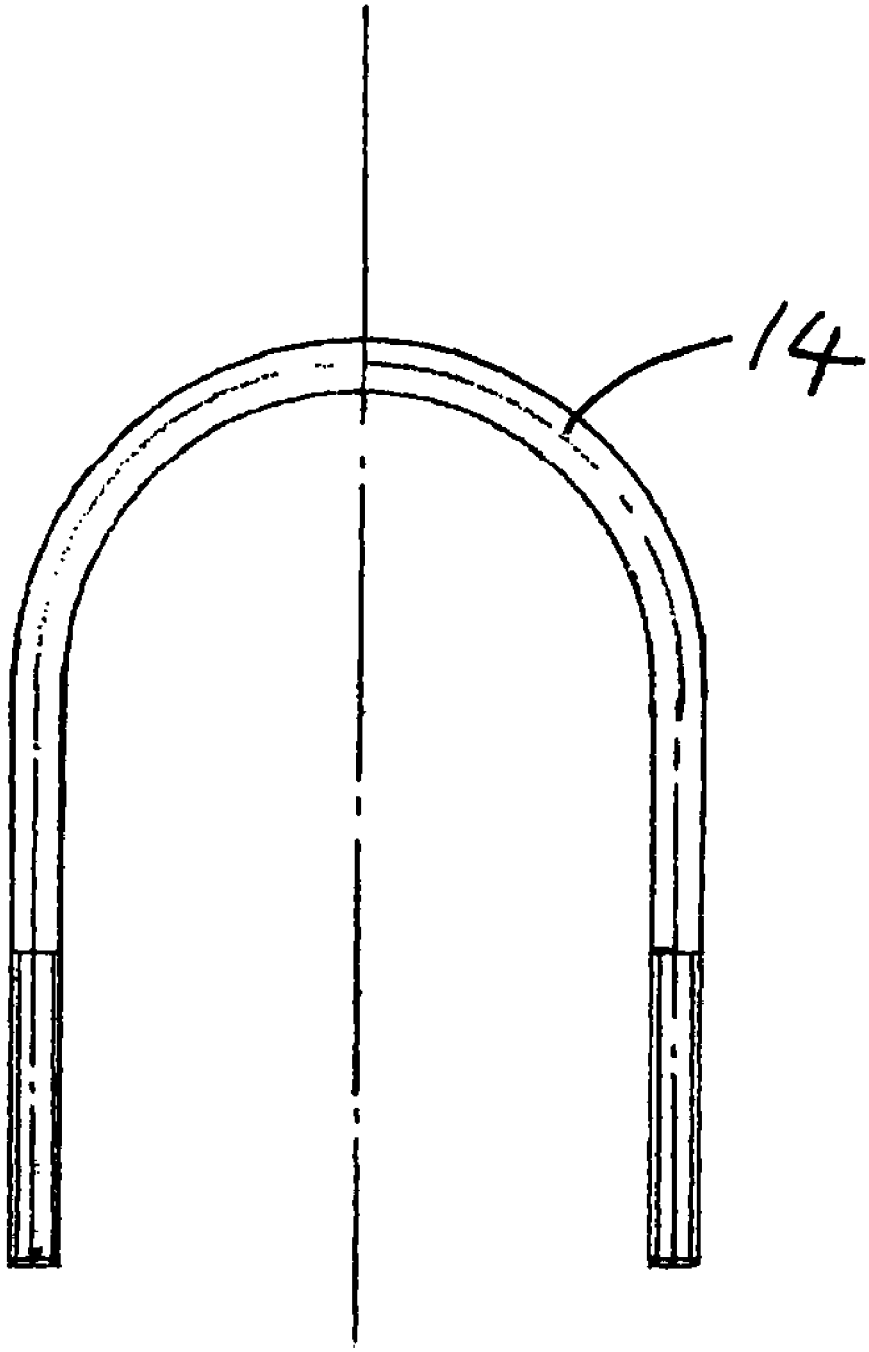
FIG. 4 is a side view illustrating a U-bolt
Figure 5:
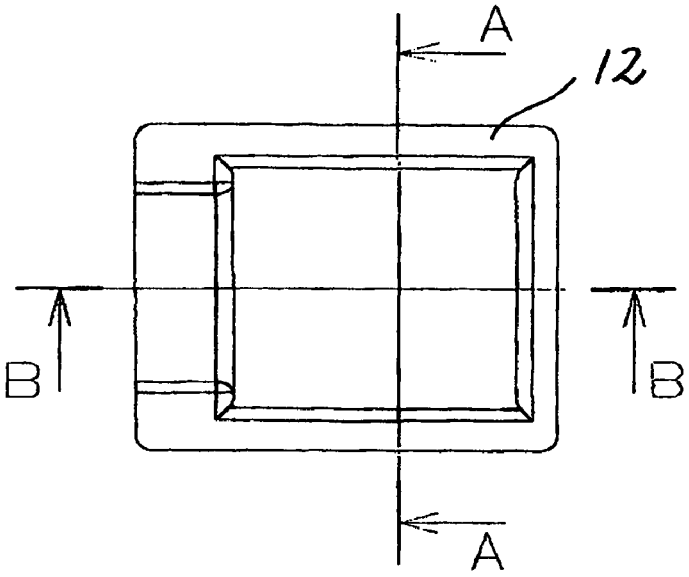
FIG. 5 is a plan view illustrating a rubber pedestal.
Figure 6:
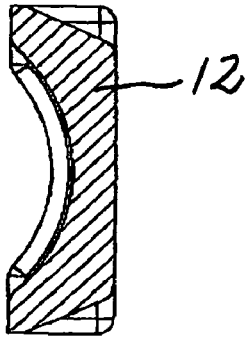
FIG. 6 is a sectional view along line A-A in FIG. 5.
Figure 7:
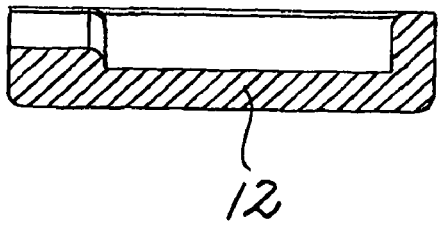
FIG. 7 is a sectional view along line B-B in FIG. 5.
Figure 8:
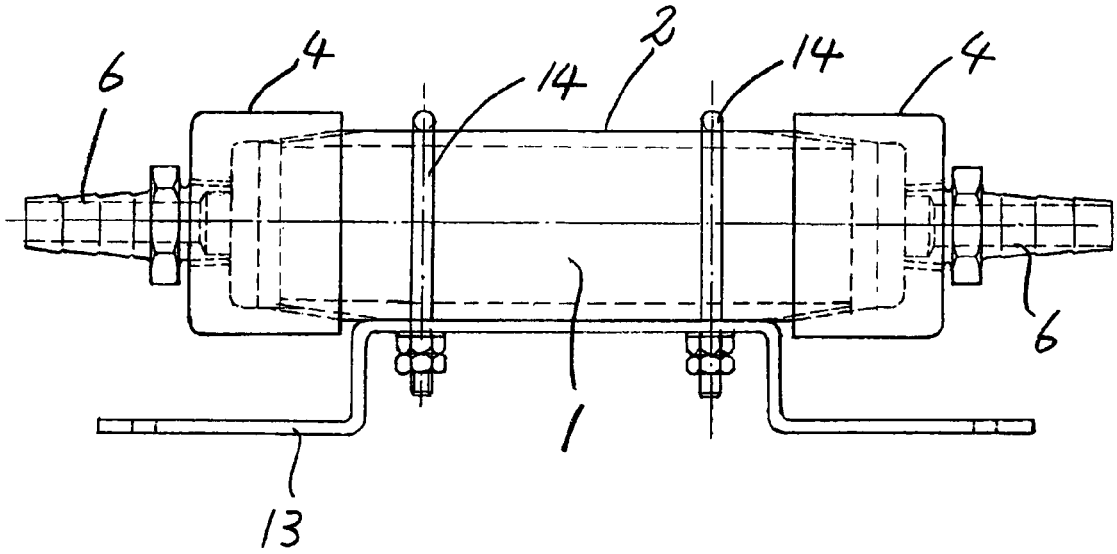
FIG. 8 is a schematic view for explaining a condition in which the passing type fuel reformer according to the present invention is mounted to the steel pedestal.
Figure 9:
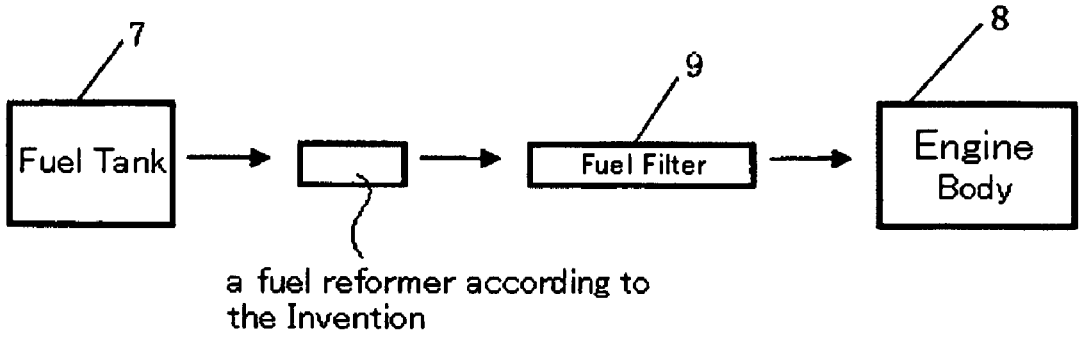
FIG. 9 is a schematic view for explaining a mounting position of the passing type fuel reformer according to the present invention.
Figure 10:
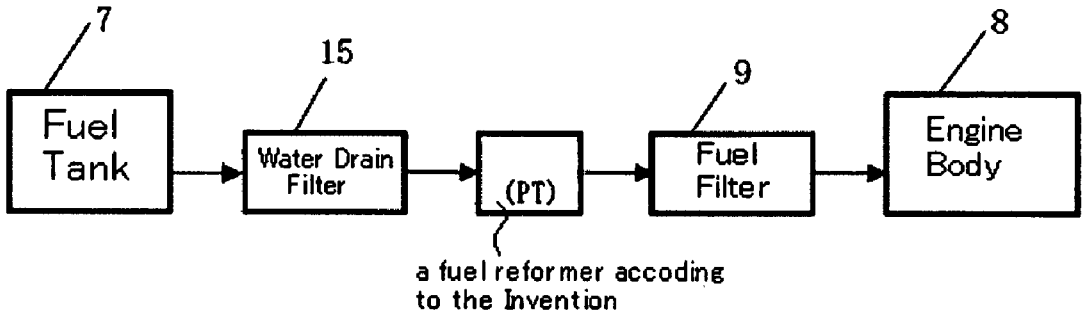
FIG. 10 is a schematic view for explaining a mounting position, in another example, of the passing type fuel reformer according to the present invention.
Figure 11:
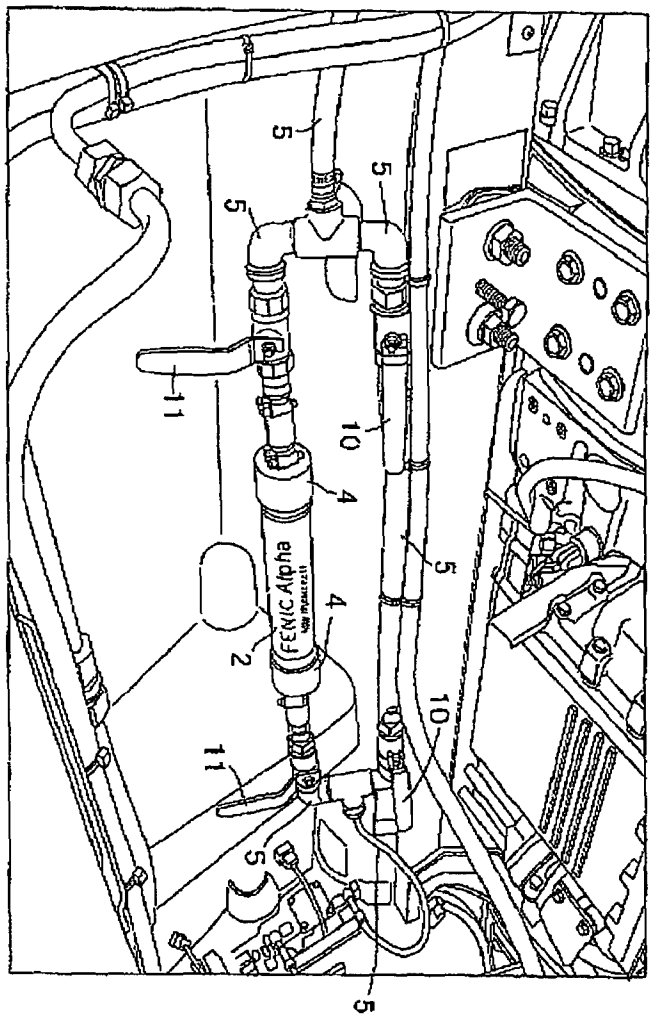
FIG. 11 is a schematic perspective view illustrating the passing type fuel reformer according to the present invention, which is attached to an intermediate part of a branching fuel hose.

1 refers to a cylindrical body charged with spherical particles 1*c*. There are shown a cylindrical body 1 which has through-holes 1*a* having a diameter smaller than the diameter of the cylindrical body 1 and formed in the peripheral surface of the cylindrical body 1 and the surfaces of lids 1*b* provided at opposite ends of the cylindrical body 1, and spherical particles 1*c* having a substantially equal diameter and formed by kneading ceramic powder and radioactive rare-earth mineral ore powder, and then granulating, drying, calcining and polishing them. The cylindrical body 1 has a rate of opening area which not less than 50% of the enter surface area of the cylindrical body. It is preferable that the spherical particles is charged in the cylindrical body 1 normally with a filling rate of not less than 90%, but may be charged with a filling rate of less than 90%.

The cylindrical body 1 is made of a material having an oil resistance, heat resistance and rust prevention, such as stainless steel, that is, it is formed by bending a plate made of, for example, a SUS304 material and having a thickness of 0.4 mm into a cylindrical shape, and by welding its seam. The cylindrical body 1 may have a diameter of 12 mm, 16 mm, 25 mm, 30 mm, 35 mm, 50 mm or the like and a length of 50 mm, 75 mm, 100 mm, 150 mm, 200 mm or the like in view of an object to be applied, such as a truck, a bus or a small type marine vessel. The through-holes 1*a* has a size which is smaller than a diameter of spherical particles 2 which will be explained latter. In this embodiment, holes having a diameter of 4 mm are formed one by one by punching. The reason why the rate of opening area of not less than 50% is set, is such that the spherical particles 1*c* charged in the cylindrical body 1 may be efficiently made into contact with liquid fuel. In this embodiment, the rate of opening area is set to 58%, but the present invention should not be limited to this value.

The ceramic powder from which the spherical particles 1*c* are made, is basically composed of alumina and silica, and further, the radioactive rare-earth mineral ore powder is obtained by grinding rare-earth mineral ore having a radioactive substance such as thorium oxide or the like. The blending rate between the ceramic powder and the radioactive rare-earth mineral ore powder are set to about 70%:30% by weight, and these powders are mingled thereinto with a binder and are then kneaded, granulated, dried, calcined (at a temperature from 1,280 to 1,300 deg. C.) and polished so as to form spherical particles 1*c* having a substantially equal diameter (about 5.5 mm). The reason why the spherical particles 1*c* have a substantially equal diameter, is such that the spherical particles 1*c* charged in the cylindrical body 1 are made to be uniform so as to increase their areas making contact with liquid fuel but to decrease their areas making contact with adjacent spherical particles 1*c* as possible as it can while ensuring slight gaps therebetween through which the liquid fuel can flow. The spherical particles 1*c* are charged in the cylindrical body 1 with a filling rate of not less than 90% since their areas making contact with the liquid fuel are increased as possible as it can. Should the spherical particles 1*c* be excessively charged, the spherical particles 1*c* would be pressed against the adjacent those so as to limit their free-path, unpreferably resulting in decreased areas making contact with the liquid fuel. It is preferable to set the filling rate so that the respective spherical particles 1*c* have buoyancy in the liquid fuel, and accordingly, they may be freely rotated. In this embodiment, the filling rate is set to 98%. It is natural that the radioactive substance in the radioactive rare-earth mineral ore should be safe so as to fall within a regally allowable range.

The cylindrical body 1 covered at its opposite ends with lids 1*b* is loosely fitted in a rigid tube body 2 made of a material having a heat-resistance, a cold-resistance and a weather-resistance. Further, a seal member 3 such as an O-ring is fitted between the outer peripheral surface of the cylindrical body 1 and the inner peripheral surface of the rigid tube body 2. The rigid tube body 2 is provided at its opposite ends with connectors 4 which are removably connected to the opposite ends thereof through screwing member or the like. Since the seal member 3 is fitted, the fuel fed from a fuel tank 7 through the a fuel pipe 5 may completely pass through the through-holes 1*a* in the cylindrical body 1, making contact with a large number of the spherical particles 1*c* so as to aim at improving combustion rate and fuel consumption or the like. The connectors 4, 4 are provided thereto with connection pipes 6 by which the connectors 4 are connected to the fuel pipe 5.

The passing type fuel reformer according to the present invention is connected in the intermediate part of the fuel pipe 5 connected between the fuel tank 7 and the engine body 8. A drain filter 15 and a fuel filter 9 for preventing occurrence of clogging by sludge, dust or the like are connected in the fuel pipe 5 connecting between the passing type fuel reformer and the engine body 8. When the passing type fuel reformer according to the present invention is installed, the fuel pipe 5 is preferably connected thereto with a bypass branch so as to install the passing type fuel reformer at a bypass position in order to further ensure a safety. In the case of the installation thereof at the bypass position, a valve 10 connected in the fuel pipe 5 at a non-bypass position is closed in order to prevent the liquid fuel from flowing through the fuel pipe 5 when the passing type fuel reformer according to the present invention is operated.

There are provided valves 11 connected to the fuel pipe 5, upstream and downstream of the bypass branch on the passing type fuel reformer side.

The passing type fuel reformer according to the present invention which is connected to the fuel pipe 5 connecting the fuel tank 7 with the engine body 8 is mounted on a steel band on the fuel tank 7, being secured to a rubber pedestal 12 by screws or the like, that is, the passing type fuel reformer according to the present invention is pressed and fixed by the rubber pedestal 12 having a vibration isolating function. In such a case that no steel band is present, the rigid tube body 2 is mounted to a chassis located on the rear side of the fuel tank 7 in such a manner that the rigid tube body 2 is set on a stainless steel pedestal 13 attached to the chassis and is fastened with a U-bolt 14.

Example 1

Summary of Results of Tests, and Effect of Improvement in Fuel Consumption Rate A passing type fuel reformer PS-100 according to the present invention (having an overall length of 245 mm with the connectors being fitted to opposite ends of the rigid tube body having an outer diameter of 42.7 mm and entirely covered with a thermo-shrinkable tube) was installed between an engine 6M132A-2 manufactured by Komatu Co., and installed on a marine vessel of #Marukame, and a fuel tank, and an improvements effect of fuel consumption rate was measured during actual cruising of the vessel on the sea.

The cruising on the sea was carried out in such a manner a fuelometer was mounted to the engine while a cruising distance was set to 3 miles (4.8 km since 1 mile=1.6 km) which was set on a GPS installed in the test vessel in order to precisely maintain the cruising distance, and a round-trip was carried out at a full speed base. Without the passing type fuel reformer PS-1200 according to the present invention being installed, the marine vessel in the current condition is round tripped at a cruising speed between setting points of 3 miles (4.8 km), and thereafter, the vessel on which the passing type fuel reformer PS-1200 according to the present invention was at once installed, was again round-tripped at the cruising speed between the same setting points of 3 miles (4.8 km), and a fuel consumption quantity was measured.

With the results of the tests in which the vessel was round tripped at the cruising speed by 3 miles (4.8 km), the fuel consumption quantity in the current condition was 18.222 liters on the outgoing trip on which the measuring time was longer due to high waves, and 16.684 liters on the on-coming trip. After the installation of the passing type fuel reformer P-1200 according to the present invention, the fuel consumption quantity was 14.093 litters on the outgoing trip and 17.722 litters on the on-coming trip. Thus, as to data before the installation, it was determined to take the result on the on-coming trip since the wave conditions on both cases were relatively similar thereon.

The total cruising distance was 3 miles (4.8 km) before the installation and was 6 miles (9.6 km) after the installation, and accordingly, the fuel consumption rate was 0.287 km/litter in the current condition and was 0.333 km/litter after the installation of the passing type fuel reformer PS-1200 according to the present invention, that is, there was found an improvement effects of 16.02%.

Details of Results of the Tests are as Follows:

Report of Improvement Effect of Fuel Consumption Rate by Passing Type Fuel Reformer according to the Present Invention with Marine Engine installed on #Marukame:

Data of Test Items:

Data of #Marukame owned by Hosaka Marine Projects Co., Ltd:

Engine: Manufactured by Komatsu Co., Registration No.: #241-11805,

Type: 6M132A-2, Horse Power: 700 HP,

Gross Tonnage: 11 t (11.94 m), Kind of Fuel: Gas Oil,

Tank Capacity: 3,500 litters, Manufacturing Date: Mar. 29, 1980

Test Method:

The test vessel was round-tripped between cruising points of 3 miles (4.8 km) which have been set southeastward by a GPS incorporated in the vessel, offshore of Yumigasaki fishing port in both current condition in which the passing type fuel reformer PS-1200 according to the present invention was not installed and fuel reforming condition in which the passing type fuel reformer PS-1200 according to the present invention was installed, and fuel consumption quantities of the engine were measured and compared with each other in order to ascertain an improvement effect in fuel consumption rate by the passing type fuel reformer PS-1200 according to the present invention.

The vessel was piloted by the captain, Mr. Kameki Suzuki.

Test Results:

A time for the on-coming trip between the cruising points of 3 miles (4.8 km) was 9 min. 24 sec. in the current condition and time for the outgoing trip was 9 min. 26 sec. while time for the on-coming trip was 9 min. 15 sec. in the fuel reforming condition in which the passing type fuel reformer PS-1200 according to the present invention was installed, with extremely accurate cruising.

The averaged cruising speeds during cruising of 3 miles (4.8 km) was maintained substantially equal to one another, that is, it was 30.63 km/h on the on-coming trip in the current condition, and after the installation of the passing type fuel reformer Ps-1200 according to the present invention, it was 30.53 km/h on the outgoing trip while it was 31.13 km/h on the on-coming trip.

The fuel consumption quantity of the engine during this period was 16.684 litters on the on-coming trip in the current condition, and after the installation of the passing type fuel reformer PS-1200 according to the present invention, it was 14.093 litters on the outgoing trip while it was 14.722 litters on the oncoming trip. Thus, the fuel consumption rate which is a cruising distance per litter of fuel, was 0.287 km/litter in the current condition on the oncoming trip, and was 0.340 km/litter on the outgoing trip while was 0.326 km/litter on the on-coming trip after the installation of the passing type fuel reformer PS-1200 according to the present invention. That is, the total improvement rate of the fuel consumption rate was 16.02%.

Further, the fuel consumption quantity per hour was 106.493 litters/h on the on-coming trip in the current condition, and was 89.637 litters/h on the outgoing trip while 95.494 litters/h on the oncoming trip after the installation of the passing type fuel reformer PS-1200 according to the present invention. Thus, the total improvement rate was 13.10%.

It is considerer that the above-mentioned comparison result is reasonable since terms of comparisons are coincident with each other between the current condition and the condition after the installation of the passing type fuel reformer PS-1200 according to the present invention.

Remarks after Confirmation Test for Improvement Effect of Fuel Consumption Rate

As indicated by the test results, the passing type fuel reformer PS-1200 according to the present invention may immediately exhibit reforming of fuel by installing it in the vicinity of an engine with the improvement rate of fuel consumption of 16.02%, and accordingly, it is found that the combustion of the engine may be surely improved.

The fuel consumption improvement rate in view of economic trial calculation was calculated at 10% and 5% with an extra margin since the cruising conditions on the sea were not uniform.

Example 2

Summary of Confirmation Test for Fuel Improvement Effect and Results Thereof As a confirmation test for the improvement effect of fuel consumption, actual marine vessel test was carried out with the use of the passing type fuel reformer PS-1200 according to the present invention (the total length of 245 mm with the connectors were attached to opposite ends of the rigid tube body, the outer diameter of the rigid tube body of 42.7 mm with a thermally shrinkable tube covered thereon) in such a way that a diving marine vessel #Total Flower (installed with two engines having 350 HP, and manufactured by Yammer Co.) owned by Hosaka Marine Project Co. Ltd., on which a fuel consumption meter manufactured by Okuda Industry Co., Ltd. was installed, was sailed southeastward offshore of Yumigasaki by a cruising distance of 8 miles and was returned on the same course. In order to maintain measurement accuracy, data was taken on the same cruising course in both conditions before and after the installation of the passing type fuel reformer. In this test, the passing fuel reformer PS-1200 according to the present invention was installed on only the right one of the two engines, and a fuel consumption quantity, a cruising time and a cruising distance were measured. The left engine was also installed thereon with a fuel consumption meter manufactured by Okuda Co., Ltd. so as to measure a fuel consumption quantity, a cruising time and a cruising distance as reference data.

During the cruising test on one and the same day, a fuel consumption was measured at first time in the current condition before the installation of the passing type fuel reformer according to the present invention, then at second time, the cruising was carried out with use of a passing type fuel reformer PS-1400 according to the present invention (the total length of 245 mm with the connectors being fitted to the opposite ends of the rigid tube body, the outer diameter of the rigid tube body of 60.5 mm with being covered with thermo shrinkable tube over its entirety), and at third time, the cruising was carried out with the use of the passing type fuel reformer PS-1200 according to the present invention. The improvement rates ware calculated from difference in fuel consumption.

The cruising courses thus taken were set so to be uniform from the first time test and the second time test with the use of a GPS.

Through the three time tests, no substantial difference was appreciated as to the cruising distance and the cruising time. Further, no substantial variation in the weather condition and the atmospheric temperature was found, that is, it was considered that the environment for the test was optimum for comparing and confirming the improvement effects of fuel consumption.

Thus, the fuel consumption rate was 0.572 km/litter in the condition before the use of the passing type fuel reformer according to the present invention. This fuel consumption rate was improved to 0.689 km/litter in the second time test with the use of the passing type fuel reformer PS-1400 according to the present invention, that is, the improve rate was 20.45%. The fuel consumption rate was improved up to 0.669 km/litter in the second time test with the use of the passing type fuel reformer PS-1400 according to the present invention, that is, the improvement rate was 16.95%. Further, the respective fuel consumption rates per hour were 11.25% and 10.47% as indicated as attached.

Confirmation Test for Improvement effect of Fuel Consumption by Passing type Fuel Reformer according to the Present Invention with the use of Diver Marine Vessel #Total Flower owned by Hosaka Marine Project Co., Ltd.

Test Marine Vessel

Engine manufactured by Yammer, Registration No. 825 (243-18585)

Type: 6CX-ET, Horse Power: 350 HP×2.

Gross Tonnage: 17 t(11.9 m), Kind of Fuel: Gas Oil,

Tank Capacity: 2,000 Litters, Manufacture Date: Jul. 16, 1988

Pilot: Mr. Ryuzi Yamaguchi

The passing type fuel reformer PS-1200 and PS-1400 were each installed between the engine and the fuel tank, and an improvement effect of fuel consumption was measured during cruising with the use of an actual marine vessel.

Test Cruising Course

Round trip to a 3 mile point southeastward from a 1 mile point offshore of Yumigasaki beach was carried out with the use of a GPS installed on #Total Flower.

Test Method

The pilot of the test marine Bessel was asked to carry out normal cruising on the test course (3 mile point southeastward from 1 mile point offshore of Yumigasaki) which has been set by the GPS. At first time, basic data such as a fuel consumption quantity, a cruising time and a cruising distance were measured in the current condition before the installation of the passing type fuel reformer according to the present invention.

After the completion of the first time test, the passing type fuel reformer PS-1400 according to the present invention was installed between the fuel tank and the engine, and the second time test was carried out. Then, during the second time test, the passing type fuel reformer PS-1200 according to the present invention was installed, then the cruising was carried out, similar to the second time test, and an improvement effect of fuel consumption was measured.

Result of Cruising Test:

From the results of the measurements, indication was made in such a way that conditions before and after the installation of the passing type fuel reformer according to the present invention may be compared with each other.

At first, the fuel consumption of the right engine before the installation of the passing type fuel reformer according to the present invention was 0.572 km/litter which was substantially equal to that of the left engine, that is, no difference in performance was found between the two engines. At second, after the installation of the passing type fuel reformer PS-1400 according to the present invention, the fuel consumption was improved up to 0.689 km/litter, that is, the improvement rate was 20.45%. Just after completion of the second time test, the passing type fuel reformer according to the present invention was replaced with PS-1200 type and then the third time test was carried out. With the result, the fuel consumption rate was 0.669 km/litter while the improvement rate of the fuel consumption was 16.95%. Further, fuel consumption rate per hour was 46.357 litters/h before the installation. Meanwhile, it was 41.142 litter/h in the second time test with the installation of the passing type fuel reformer of PS-1400 type, and the improvement rate was 11.25%. It was 41.505 litters/h in the third time test with the installation of the passing type fuel reformer of PS-1200 type, and the improvement rate was 10.47%.

The fuel consumption improvement rate in view of economic trial calculation was calculated at 10% with an extra margin since the cruising conditions on the sea were not uniform.

Example 3

Summary of Confirmation Test of Improvement Effect of Fuel Consumption and Results A confirmation test of improvement effect of fuel consumption was carried out through two days with the use of a passing type fuel reformer PS-600 (total length of 130 mm with the connectors being fitted to opposite ends of the rigid tube body having an outer diameter of 34 mm, the rigid tube body being covered with a thermo shrinkable tube over its entirety) which was installed on each of delivery vehicles owned by Logicom Japan Co. Ltd (manufactured by Nissan Diesel Co., and having a payload of 3,250 kg. Registration No. Hiroshima 11 ㄴ3808, and manufactured by Nissan Diesel Co., having a payload of 3,250 Kg. Registration No. Hiroshima 11 ㄴ4960) on each of which a fuel consumption meter manufactured by Okuda Co., Ltd. was installed. As a vehicle running course, for #3808 vehicle, there was set a usual course on which delivery was made from a Hiroshima Branch Firm of Logicom Japan Co., to convenience stores in Naka-ku Popla and to stores and automatic vending machines in Enami zone and Kanon zone, and coming back to the branch firm. For #4960 vehicle, there was taken an usual running course on which delivery was made from the Hiroshima branch firm of Logicom Japan Co., to eating houses, liquor shops, hospitals, other stores and automatic vending machines in a zone on the north side of Hiroshima Station in Higashi-ku after running along Astrum line, and thereafter coming back to the branch firm running along the Astrum line by way of Hiziyama college. In order to maintain measurement accuracy, one and the same course were to be taken as possible as it can, but the number of delivery destinies were decreased by three for #3808 vehicle, while the delivery order was changed more or less. Thus, the running distance was decreased by 1 km even though the vehicle run on the substantially same course. For #4960 vehicle, since the order of delivery was changed more or less due to rotation of drivers, the running time was extended by about 44 min., but the running distance was shortened by 1.3 km. For #3808 vehicle, two kinds of data were separately taken in two zones before and after the installation, and for #4960 vehicle two kinds of data were taken in fourteen zones before the installation and in seventeen zones after the installation since stopping of the engine was required in thickly housed areas. A fuel consumption quantity, a running time and a running distance were measured in each of sections.

Through running test between two days, on the first day, a fuel consumption was measured in the current condition before the installation of the passing type fuel reformer PS-600 according to the present invention, and on the second day, May 25, the vehicles were run with the use of the passing type fuel reformer PS-600 according to the present invention, and an improvement rate was calculated from a difference between fuel consumptions thereof.

The payload of the #3808 vehicle was 3,000 kg on the first day while it was 3,200 kg on the second day, and accordingly the difference therebetween was 200 kg.

The payload of #4960 vehicle was 1,980 kg on the first day while it was 2,040 kg on the second day, and accordingly, no appreciable difference was present therebetween.

The number of deliveries by #3808 vehicle was 31 on the first day with a running distance of 56 km, but was 28 on the second day with a running distance of 55 km shorter than the former by 1 km while the running time was also shorter than by 6 min. 35 sec.

The number of deliveries by #4960 vehicle was 22 on the first day with the running distance of 59 km, and was 26 on the second day with a running distance of 57.7 shorter than the former by 1.3 km while the running time was however longer than by about 44 min.

Since the running distances, the running times and the payloads were different between two days and since an abrupt relay between drivers was present, the conditions were worse more or less for comparison of improvements in fuel consumption, but the improvement effects of fuel consumption were dared to be compared and confirmed.

As to #3808 vehicle, the fuel consumption rate was 4.865 km/litter on the first day in the condition before the installation of the passing type fuel reformer PS-600 according to the present invention, and was improved up to 5.873 km/litter on the second day in the condition after the installation of the passing type fuel reformer PS-600 according to the present invention, that is, the improvement rate of fuel consumption was 20.71%. As to #4960 vehicle, the fuel consumption rate was 5.522 km/litter on the first day in the condition before the installation of the passing type fuel reformer PS-600 according to the present invention, and was improved up to 6.120 km/litter on the second day in the condition after the installation of the passing type fuel reformer PS-600 according to the present invention, that is, the improvement rate of fuel consumption was 10.82%.

Confirmation Test of Improvement Effect by Passing Type Fuel Reformer PS-600 according to the Present Invention with the use of Delivery Vehicle owned by Logicom Japan Co., Ltd.

Test Vehicle

Driver: Mr. Keiou Hashimoto

Kind of Vehicle: Manufactured by Nissan Diesel Co., Registration No. Hiroshima 11 ぞ3808, Vehicle Body No. H4NS41015119, Type: U-UH4NS41 modified, Payload: 3,250 kg, Engine Displacement: 4,610 cc, Kind of Fuel: Gas Oil, Vehicle Weight: 3,420 kg, Tank Capacity: 80 litters, Manufacturing Date: January, 1994

Test Vehicle

Driver; Mr. Daisaku Sugamoto on the first day, and Mr. Yoshibumi Moriwaki on the second day Kind of Vehicle: Manufactured by Nissan Diesel Co., Registration No. Hiroshima 11 ぞ4960, Vehicle Body No. H4NS41015346, Type: U-UH4NS41 Modified, Payload: 3,250 kg, Engine Displacement: 4,610 cc., King of Fuel: Gas Oil, Vehicle Weight: 3,340 kg, Tank Capacity: 80 litters, Manufacturing Date: February, 1995

#3808 vehicle and #4960 vehicles were each installed thereon with the passing type fuel reformer PS-600 according the present invention and were used.

Test Running Course

Test Running Course on First Day

For #3808 vehicle, the course: Logicom Japan Hiroshima Branch Firm→Shops in Nakaku Popla→Automatic Vending Mashines and Shops in Enami Zone and Kanon Zone→Logicom Japan Hiroshima Branch Firm, was divided into two sections in which the measurements were made.

For #49.60 vehicle, the course: Logicom Japan Hiroshima Branch Firm→Shops in Asaminami-ku Poplar→Eating Houses, Liquor Shops, Grocer'Shops, Hospitals, Automatic Vending machines and the Like on the north side of Hiroshima station in Higashi-ku→Hijiyama College→Logicom Japan Hiroshima Branch Firm, was divided into fourteen sections in which the measurements were made.

Test Running Course on Second Day

For #3808 vehicle, the course: Logicom Japan Hiroshima Branch Firm→Shops in Nakaku Popla→Automatic Vending Machines and Shops in Enami Zone and Kanon Zone→Logicom Japan Hiroshima Branch Firm, was divided into two sections in which the measurements were made.

For #4960 vehicle, the course: Logicom Japan Hiroshima Branch Firm→Shops in Asaminami-ku Poplar→Eating Houses, Liquor Shops, Grocer'Shops, Hospitals, Automatic Vending Machines and the Like on the north side of Hiroshima station in Higashi-ku→Hijiyama College→Logicom Japan Hiroshima Branch Firm, was divided into seventeen sections in which the measurements were made.

Running Time and Distance

Since the number of deliveries by #3808 vehicle was smaller than by 3 on the second day, the running distance was shorter than by 1 km while the running time was shorter than by 6 min. 35 sec. As to #4960 vehicle, the number of deliveries was 22 on the first day, and the running distance was 59 km, but on the second day, the number of deliveries was 26 which was greater than 4, but the running distance was 57.7 km which was shorter than by 1.3 km while the running time was longer than by about 44 min.

Loading Condition:

As to #3808 vehicle, no difference was appreciated in the same section between data 2 on the first day and data 2 on the second day.

A difference 200 kg was appreciated in the other section (data 1).

As to #4960 vehicle, no difference was appreciated in the payload between the first day and the second day.

Test Method

The drivers of the test vehicles were asked to run the vehicle on a usual delivery course as a test course. On the first day, basic data including a fuel consumption quantity, a running distance and a running time was measured in the current condition before the installation of the passing type fuel reformer PS-600 according to the present invention in each of the two sections for #3808 vehicle and in each of the fourteen sections for #4960 vehicle. After completion of the test on the first day, the passing type fuel reformer PS-600 according to the present invention was installed between the fuel tank and the engine body in each of #3808 and #4960 vehicles for the preparation of the test on the second day. On the second day, the usual running courses were taken, similar to those on the first day, and measurements similar to those in the first day were completely made in each of the two sections for #3808 vehicle, and in each of the seventeen sections for #4960 vehicle.

Results of Running Test

| | Before Inst. | After Inst. |
|---|---|---|
| | (#3808 Vehicle) | |
| Running Distance | 56.0 km | 55.0 Km |
| Running Time | 5 h. 36 min. 07 sec | 5 h. 29 min. 32 sec |
| Averaged Speed | 10.00 km/h | 10.01 km/h |
| Used Fuel Quantity | 11.509 litters | 9.364 litters |
| Fuel Consumption | 4.865 km/letter | 5.873 km/litter |
| Improvement Rate | — | 20.71% |
| | (#4960 Vehicle) | |
| Running Distance | 56.0 km | 57.7 Km |
| Running Time | 4 h. 23 min. 06 sec | 5 h. 07 min. 00 sec |
| Averaged Speed | 23.74 km/h | 23.04 km/h |
| Used Fuel Quantity | 10.684 litters | 9.427 litters |
| Fuel Consumption | 5.522 km/litter | 6.120 km/litter |
| Improvement Rate | — | 10.28% |
| | (Two Vehicle in Total) | |
| Running Distance | 115.0 km | 112.7 Km |
| Running Time | 9 h. 59 min. 13 sec | 10 h. 36 min. 32 sec |
| Averaged Speed | 11.51 km/h | 10.62 km/h |
| Used Fuel Quantity | 22.193 litters | 18.7917 litters |
| Fuel Consumption | 5.181 km/letter | 5.997 km/litter |
| Improvement Rate | — | 15.997% |

Example 4

Summary of Confirmation Test of Improvement Effect of Fuel Consumption and Result Confirmation tests of improvement effect of fuel consumption were carried out using the passing type fuel reformer PS-1200, with the use of a transport vehicle (manufactured by Hino Co., having a payload of 33,090 kg, and Registration No. Adachi 12 き4972) owned by Nitto Land Transport Co., Ltd. As an actual vehicle test course, the vehicle run starting from Nitto Land Transport Co., Home Office, running from the Rainbow Bridge Center to Shed Front of Shinkan-Sen, and after U-turn on #357 Road, coming back from Tennose Isle to Nitto Land Carriage Co., Home Office by way of Rainbow Bridge Center.

In order to maintain accuracy of data, the vehicle run on the same course with the same payload, a fuel consumption quantity, a running time and a running distance were measured.

During the running test, at first time, a fuel consumption was measured during running in a current condition before the installation of the passing type fuel reformer PS-1200 according to the present invention, and at second time, a fuel consumption was measured during running in the condition after the installation of the passing type fuel reformer PS-1200 according to the present invention. Then, an improvement rate was calculated from the difference between the fuel consumptions.

No difference in running distance and payload was appreciated between two time running tests.

Although a difference of 1 min. 43 sec. was exhibited in running time, a difference in averaged speed, which was 1.09 km/h, was substantially negligible, and accordingly, an optimum condition for comparing and confirming the improvement rate of fuel consumption could be obtained.

That is, no substantial difference in running distance, running time and payload was appreciated between the conditions before and after the installation of the passing type fuel reformer PS-1200 according to the present invention, and accordingly, the comparison and confirmation of the improvement effect of fuel consumption could be made substantially on one and the same condition. The fuel consumption rate was 2.114 km/litter during the first time test in the condition before the installation of the passing type fuel reformer PS-1200 according to the present invention, and was improved up to 2.314 km/litter during the second time test in the condition after the installation of the passing type fuel reformer PS-1200 according to the present invention. That is, the improvement rate of fuel consumption was 9.46%.

Confirmation Test of Improvement Effect of Fuel Consumption by Passing Type Fuel Reformer PS-1200 according to the Present Invention with the use of Transport Vehicle owned by Nitto Land Transport Co. Ltd.:

Test Vehicle:

Driver: Mr. Tomiichi Kuzuyama

Kind of Vehicle; manufactured by Hino Co., Registration No.: Adachi 12 き4972,

Vehicle Body No. SH4FDC10549, Type: KC-SH4FDCA,

Payload: 33,090 kg, Engine Displacement: 20,780 cc,

Kind of Fuel: Gas Oil, Vehicle Weight: 6,240 kg,

Tank Capacity: 300 litters×2, Manufacturing Date: March, 1997.

The passing type fuel reformer PS-1200 according to the present invention was installed between the fuel tank and the engine.

First Time Course

Nitto Land Transport Co., Home Office→Rainbow Bridge Center→Shed Front of Shinkan-Sen→U-Turn on #357 Road→Tennozu Isle→Rainbow Bridge Center→Nitto Land Transport Co., Home Office. The measurements were made on this course.

Second Time Course

Nitto Land Transport Co., Home Office→Rainbow Bridge Center→Shed Front of Shinkan-Sen→U-Turn on #357 Road→Tennozu Isle→Rainbow Bridge Center→Nitto Land Transport Co., Home Office.

Payload Condition

The first and second time tests were carried out both with a payload of 8.0 t.

Date on which the Tests were carried out:

Test Method:

The driver of the test vehicle run on the test course as usual, and pre-installation data such as a fuel consumption quantity, a running time, a running distance and the like were measured in the condition before the installation of the passing type fuel reformer PS-1200 according to the present invention.

After the completion of the first time test, the passing type fuel reformer PS-1200 according to the present invention was installed between the fuel tank and the engine, and the second time test were carried out for the measurements.

Result of the Running Test

| | Before Inst. | After Inst. |
|---|---|---|
| Measuring Time | 13:38 to 14:26 | 14:53 to 15:43 |
| Running Distance | 24.4 km | 24.4 Km |
| Running Time | 47 min. 53 sec | 49 min. 36 sec |
| Payload | 8.000 kg | 8,000 kg |
| Averaged Speed | 30.57 km/h | 29.51 km/h |
| Used Fuel Quantity | 11.543 litters | 10.546 litters |
| Fuel Consumption | 2.114 km/litter | 2.314 km/litter |
| Improvement Rate | — | 9.46% |

Example 5

Summary of Confirmation Test of Improvement Effect of Fuel Consumption and Result A confirmation test of improvement effect of fuel consumption, using the passing type fuel reformer PS-1200 according to the present invention, was carried out with the use of a transport vehicle (manufactured by DAEWOO Co. and having a payload of 25,000 kg) owned by Seibu Terminal Co., on which a fuel consumption meter manufactured by Okuda Industry Co., Ltd. As to a test course, the vehicle run on an ordinary road having a relatively stable traffic volume in a suburban and on a highway by a distance of 46 km so as to carry out a running test. In order to maintain accurate data, one and the same course was taken for the running test before and after the installation so as to separately obtain data before the installation and data after the installation, that is, a fuel consumption quantity, a running time and a running distance were measured.

Of two time running tests, at a first time one, a fuel consumption was measured in the current condition before the installation of the passing type fuel reformer PS-1200 according to the present invention, and at the second time one, the running test was made in the condition after the installation of the passing type fuel reformer PS-1200 according to the present invention, and further, an improvement rate was calculated from a difference between the fuel consumption quantity.

The payload for data 1 at the first time was identical with that for data 2 at the second time.

The running distances were equal to each other since the test course was set.

The running time was longer before the installation than after the installation by 1 min. 59 sec. due to various circumstances such as stopping at traffic signals or jamming at toll gates.

Between two running tests, no difference in running distance and payload was appreciated. Although a difference of 1 min 59 sec in running time was appreciated therebetween, since a difference between averaged speed, that is, 2.20 km/h, was slight in view of running on the highway, this condition was optimum for comparing the improvement effect of fuel consumption.

As to the results, The fuel consumption rate was 3.450 km/litter in the condition before the installation of the passing type fuel reformer PS-1200 according to the present invention, and was improved up to 3.936 km/litter in the second time running test in the condition after the installation of the passing type fuel reformer PS-1200 according to the present invention. That is, the improvement rate of the fuel consumption was 14.08%.

Confirmation Test of Fuel Consumption by Passing Type Fuel Reformer according to the Present Invention with the use of Transport Vehicle owned by Seibu Terminal Co.

Driver: Mr. Kityu Kin

Test Vehicle

Kind of Vehicle: manufactured by DAEWOO Co., Registration No. Keiki 96 ㄱ6323,

Payload: 25,000 kg, Engine Displacement: 14,987 cc,

Kind of Fuel: Gas Oil, Horse Power: 420 ps,

Tank Capacity: 300 litters, Manufacturing Date: November, 2002

The passing type fuel reformer PS-1200 according to the present invention was used being installed between the fuel tank and the engine.

Running Test Course

The running test course was one and the same between the first time and the second time since the measurements were made between the same points between which the vehicle run on both the ordinary road and the highway and came to a stop after running by a distance of 46 km in the suburban of Seoul City.

Running Time and Distance

No difference in running distance was appreciated since the vehicle run on one and the same test course, but the running time was longer before the installation than after the installation by 1 min. 59 sec due to stopping at traffic signals and jamming at toll gates.

Payload

No difference in pay load was appreciated.

Test Method

The driver run the vehicle usually on the ordinary road and the highway as a test course in the suburban of Seoul City, and at first time, basic data as to a fuel consumption quantity, a running time and a running distance or the like was measured in the current condition before the installation of the passing type fuel reformer PS-1200 according to the present invention. After the completion of the first time running test, the passing type fuel reformer PS-1200 according to the present invention was installed between the fuel tank and the engine body for the preparation of the second time running test. Next, during the second running test, a usual running was carried out similar to that during the first time running test, and measurements similar to that during the first time were carried out.

Results of Running Test

| | Before Inst. | After Inst. |
|---|---|---|
| Running Distance | 46.0 km | 46.0 Km |
| Running Time | 50 min. 50 sec | 48 min. 51 sec |
| Averaged Speed | 54.29 km/h | 56.49 km/h |
| Used Fuel Quantity | 13.333 litters | 11.688 litters |
| Fuel Consumption | 3.450 km/litter | 3.936 km/litter |
| Improvement Rate | — | 14.08% |

Example 6

Summary of Confirmation Test of Improvement Effect of Fuel Consumption and Result A confirmation test of improvement effect of fuel consumption by the passing type fuel reformer PS-1200 according to the present invention was carried out on a cruising test of an actual marine vessel on which ordinary visitors board for enjoying and sightseeing with the use of a sightseeing pleasure marine vessel #Searoman (having 320 HP engine manufactured by Yammer Co.,) owned by Dogashima Marine Co., Ltd., on which a fuel consumption meter manufactured by Okuda Industry Co., Ltd. was mounted. In order to maintain accurate data, data before the installation and data after the installation were measured on one and the same cruising course by three times, respectively. Further, with the installation of the passing type fuel reformer PS-1200 according to the present invention, a fuel consumption and a cruising time were measured. It is noted that a number of passengers was different due to the actual marine vessel cruising test with the use of the sightseeing pleasure marine vessel.

During the cruising test on that day, a fuel consumption was measured in the current condition before the installation of the passing type fuel reformer PS-1200 according to the present invention, from the first to second time test, and thereafter, that is, from the fourth to sixth time test, the cruising was carried out with the use of the passing type fuel reformer PS-1200 according to the present invention, and an improvement rate was calculated from a difference in fuel consumption. The first to sixth time test were carried out on a usual sightseeing excursion course, that is, on one and the same cruising course.

The cruising times were substantially equal to each other through the first to sixth time tests.

The cruising time for data before the installation, was 20 min. 00 sec at the first time, 19 min. 55 sec. at the second time, and 19 min. 36 sec. at the third time, and accordingly, a maximum time difference was 24 sec. The cruising time for data after the installation was 20 min. 16 sec. at the fourth time, 20 min. 02 sec at the fifth time and 20 min. 03 sec. at the sixth time, and accordingly, a maximum time difference was 14 sec. Except the fuel consumption at the fourth time, variation in fuel consumption quantity were uniform with no excessive unevenness even under such a condition that the number of passengers was not uniform throughout service hours, and the weather and the atmospheric temperature were not changed appreciably, that is, the condition were optimum for comparing and confirming improvement effects of fuel consumption. Thus, the fuel consumption rate per hour throughout the tree time tests was 5.923 litters/h in the condition before the installation of the passing type fuel reformer PS-1200 according to the present invention, and was improved up to 5.147 litters/h in the fourth to sixth time tests in which the passing type fuel reformer according to the present invention was used. Thus, the improvement rate of fuel consumption was 13.10%. Further, the averaged fuel consumption quantity throughout the three time tests was 1.959 little the condition before the installation of the passing type fuel reformer PS-1200 according to the present invention, and was improved up to 1.726 litters in the condition after the installation of the passing type fuel reformer PS-1200 according to the present invention. That it was improved by 11.89%.

Confirmation Test of Improvement Effect of Fuel Consumption by Passing Type Fuel Reformer PS-1200 according to the Present Invention with the use of Sightseeing Pleasure Marine Vessel #Searoman owned by Dogashima Marine Co. Ltd.

Test Marin Vessel

Engine: made of Yammer Co., Registration No. 241-14890,

Type: 6LY-ST, Horse Power: 320 HP (270 HP),

Gross Tonnage: 10 t (11.50 m),

Kind of Fuel: Gas Oil, Tank Capacity: 670 litters,

Use Purpose: Passenger Marine Vessel

Pilot: Mr. Hazime Saino

The passing type fuel reformer PS-1200 according to the present invention was installed between the engine body and the fuel tank, and an improvement effect of fuel consumption was measured on the sea during an actual marine Bessel cruising on the sea.

Test Method

The pilot of the test marine vessel carried out usual cruising on a usual sightseeing pleasure course (an averaged time 20 min was taken inshore of Dogashima), basic data such as a fuel consumption quantity, a cruising time and the like was measured in the current condition before the installation of the passing type reformer according to the present invention, from the first to second times. After the completion of the second time test, the passing type fuel reformer PS-1200 according to the present invention was installed between the engine body and the fuel tank, and the test was carried out from the fourth to sixth time in order to measure the improvement effect of fuel consumption.

Result of Test

The fuel consumption per one hour cruising was 5.923 litters/h in the condition before the passing type fuel reformer PS-1200 according to the present invention, throughout the first to second time test. It was improved up to 5.147 litter/h in the condition after the installation of the passing type fuel reformer PS-1200 according to the present invention throughout the fourth to sixth time tests, and then improvement rate was 13.10%. The averaged fuel consumption quantity per one cruising was 1.959 litters before the installation, and was improved up to 1.726 litters after the installation, and the improvement rate was 11.89 which was satisfactory.

ADVANTAGES OF THE INVENTION

According to the present invention in which the fuel fed to an engine is led through the fuel reformer according to the present invention, by an entire quantity, and is then at once fed into an engine, it is possible to aim at further enhancing the improvement effect of fuel consumption, and further, the fuel reformer may be safely and surely installed in the vicinity of the fuel tank. That is, it is possible to aim at improving the fuel consumption quantity and enhancing the fuel consumption. Further, although it was used in trucks and marine vessels or the like under severe conditions, that is, excessive vibration, the vibration isolating effect may be improved, and it may be tough in long time use, and may be simply and surely installed.

Further, with the provision of filters arranged upstream and downstream of the passing type fuel reformer according to the present invention, foreign matter such as dust from the fuel tank side may be surely blocked, and accordingly, high quality clean fuel may be fed into the engine body.

Further, in the case of the installation on a fuel tank, an engine or the like in e.g. a marine vessel, since the fuel pipe is of bypass type, either one of the use and nonuse of the reformer according to the present invention may be simply selected only by closing one of the valves.

The spherical particles substantially having one and the same diameter are formed by kneading ceramic powder and radioactive rare-earth mineral ore powder, and then by granulating, drying, calcining and polishing them, and by forming through-holes having a diameter small than that of the spherical particles, in the peripheral surface of the cylindrical body, and in the surfaces of the lids formed at the opposite ends of the cylindrical body at a rate of opening area of not less than 50%, liquid fuel may make contact with the spherical particles by the entire quantity thereof, and as well hydrocracking reaction of molecules in fuel components may be caused due to multifunction by α-ray, β-ray or γ-ray radiation, far-infrared radiation, magnetic radiation, excitation and the like, resulting in lowering of distillate temperature, enhancement of fuel consumption and acceleration due to improvement in the quality of liquid fuel, lowering of combustion noise, and in particular, reduction of CO, HC, black smoke (emitted from Diesel-engine vehicles) and the like in exhaust gas.

The invention claimed is:

1. A passing type fuel reformer comprising a cylindrical body having a peripheral surface, said cylindrical body being covered at opposite ends with lids and formed in the peripheral surface thereof and in the surfaces of the lids with through-holes said cylindrical body being charged at a filling rate of not less than 90% with spherical particles having a substantially equal diameter where said spherical particles are formed by a process comprising kneading, granulating, drying, calcining and polishing a ceramic powder with a radioactive rare-earth mineral ore powder, said through-holes having a diameter smaller than that of the spherical particles with an open area of said lids being not less than 50%, said cylindrical body being fitted in a rigid tube body where said rigid tube body is provided with a seal member between an outer peripheral surface of the cylindrical body and an inner surface of the rigid tube body said seal member being located so that more than one flow-path into the rigid tube body is provided, said rigid tube body having connectors removably fitted to said opposite ends of the rigid tube body for connection to a fuel pipe between a fuel tank and an engine.

2. A passing type fuel reformer as set forth in claim 1, characterized in that the passing type fuel reformer is installed in a fuel pipe between a fuel tank and an engine wherein said fuel pipe is provided with a bypass branch having two valves connected to the fuel pipe upstream and downstream of the bypass branch that allow fuel to bypass said passing type of fuel reformer.

* * * * *

UNITED STATES PATENT AND TRADEMARK OFFICE

CERTIFICATE OF CORRECTION

PATENT NO. : 8,104,455 B2
APPLICATION NO. : 10/570379
DATED : January 31, 2012
INVENTOR(S) : Shizuo Kitajima, Takashi Watanabe and Noriya Sekine It is certified that error appears in the above-identified patent and that said Letters Patent is hereby corrected as shown below:

On the Title Page

(73) Assignee should read: Fenic Co., Ltd., Kanagawa (JP)

Signed and Sealed this
Twenty-first Day of October, 2014

Michelle K. Lee

Michelle K. Lee
*Deputy Director of the United States Patent and Trademark Office*